US010151161B2

(12) United States Patent
Pelletier et al.

(10) Patent No.: US 10,151,161 B2
(45) Date of Patent: Dec. 11, 2018

(54) WELL TELEMETRY WITH AUTONOMOUS ROBOTIC DIVER

(71) Applicant: Halliburton Energy Services, Inc., Houston, TX (US)

(72) Inventors: Michael T. Pelletier, Houston, TX (US); David L. Perkins, The Woodlands, TX (US); Li Gao, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/899,056

(22) PCT Filed: Nov. 13, 2014

(86) PCT No.: PCT/US2014/065380
§ 371 (c)(1),
(2) Date: Dec. 16, 2015

(87) PCT Pub. No.: WO2016/076868
PCT Pub. Date: May 19, 2016

(65) Prior Publication Data

US 2017/0241219 A1 Aug. 24, 2017

(51) Int. Cl.
*E21B 23/00* (2006.01)
*E21B 47/14* (2006.01)
(Continued)

(52) U.S. Cl.
CPC ..... *E21B 23/00* (2013.01); *E21B 47/12* (2013.01); *E21B 47/122* (2013.01); *E21B 47/14* (2013.01);
(Continued)

(58) Field of Classification Search
CPC ..... E21B 23/00; E21B 47/18; E21B 47/12; E21B 47/122; E21B 47/14; E21B 47/00; E21B 49/00
See application file for complete search history.

(56) References Cited

U.S. PATENT DOCUMENTS 4,399,692 A 8/1983 Hulsing, II et al.
5,255,245 A 10/1993 Clot
(Continued)

FOREIGN PATENT DOCUMENTS

JP 2012-076475 * 4/2012 ..... B61B 13/10
JP WO 2014076806 A1 * 5/2014 ..... B61B 13/10

OTHER PUBLICATIONS

International Search Report and Written Opinion for International Application No. PCT/US2014/065509 dated Aug. 11, 2015.
(Continued)

*Primary Examiner* — Nicole Coy
(74) *Attorney, Agent, or Firm* — John Wustenberg; Tumey L.L.P.

(57) ABSTRACT

A telemetry apparatus for use in a well can include multiple segments, the segments comprising at least one buoyancy control device, at least one telemetry device, and at least one articulation device that controls a relative orientation between adjacent ones of the segments. A method of communicating in a subterranean well can include installing at least one telemetry apparatus in the well, the telemetry apparatus comprising a telemetry device and a buoyancy control device, and the telemetry device communicating with another telemetry device at a remote location. A well system can include at least one telemetry apparatus disposed in a wellbore, the telemetry apparatus comprising multiple segments, the segments including at least one buoyancy control device and at least one telemetry device.

10 Claims, 5 Drawing Sheets

(51) Int. Cl.

| | |
|---|---|
| ***E21B 47/18*** | (2012.01) |
| ***E21B 47/12*** | (2012.01) |
| *E21B 47/00* | (2012.01) |
| *E21B 49/00* | (2006.01) |

(52) U.S. Cl.
CPC ..... *E21B 47/18* (2013.01); *E21B 47/00* (2013.01); *E21B 49/00* (2013.01)

(56) References Cited

U.S. PATENT DOCUMENTS

| | | | |
|---|---|---|---|
| 2002/0096322 | A1 | 7/2002 | Barrett et al. |
| 2002/0185273 | A1 | 12/2002 | Aronstam et al. |
| 2009/0211754 | A1 | 8/2009 | Verret et al. |
| 2010/0122813 | A1 | 5/2010 | Trummer et al. |
| 2012/0013893 | A1 | 1/2012 | Maida et al. |
| 2013/0118733 | A1 | 5/2013 | Kumar |
| 2013/0186649 | A1 | 7/2013 | Hall |

OTHER PUBLICATIONS

Spatial Robots. Produce description (online). ACM-R5 by Hirose Fukushima Robotics Lab, Apr. 16, 2007 (retrieved Dec. 2, 2015 from Internet: http://www.spatialrobots.com/2007/04/hirose-fukushima-robotics-lab-acm-r5/).

International Search Report and Written Opinion for International Application No. PCT/US2014/065380 dated Aug. 11, 2015.

"Amphibious Snake Like Robot" retrieved from http://thefutureofthings.com/6061-amphibious-snake-like-robot/ date unknown.

* cited by examiner

WELL TELEMETRY WITH AUTONOMOUS ROBOTIC DIVER

TECHNICAL FIELD

This disclosure relates generally to equipment utilized and operations performed in conjunction with a subterranean well and, in one example described below, more particularly provides for telemetry in a well using an autonomous robotic diver apparatus.

BACKGROUND

It is beneficial to be able to communicate with sensors, actuators or other devices in wells. For example, sensor measurements can be received at a surface location, without a need to retrieve a sensor from a well. In another example, a command can be sent to a downhole device, in order to cause the device to perform a particular function. Therefore, it will be appreciated that improvements are continually needed in the art of well telemetry.

DETAILED DESCRIPTION

Figure 1:
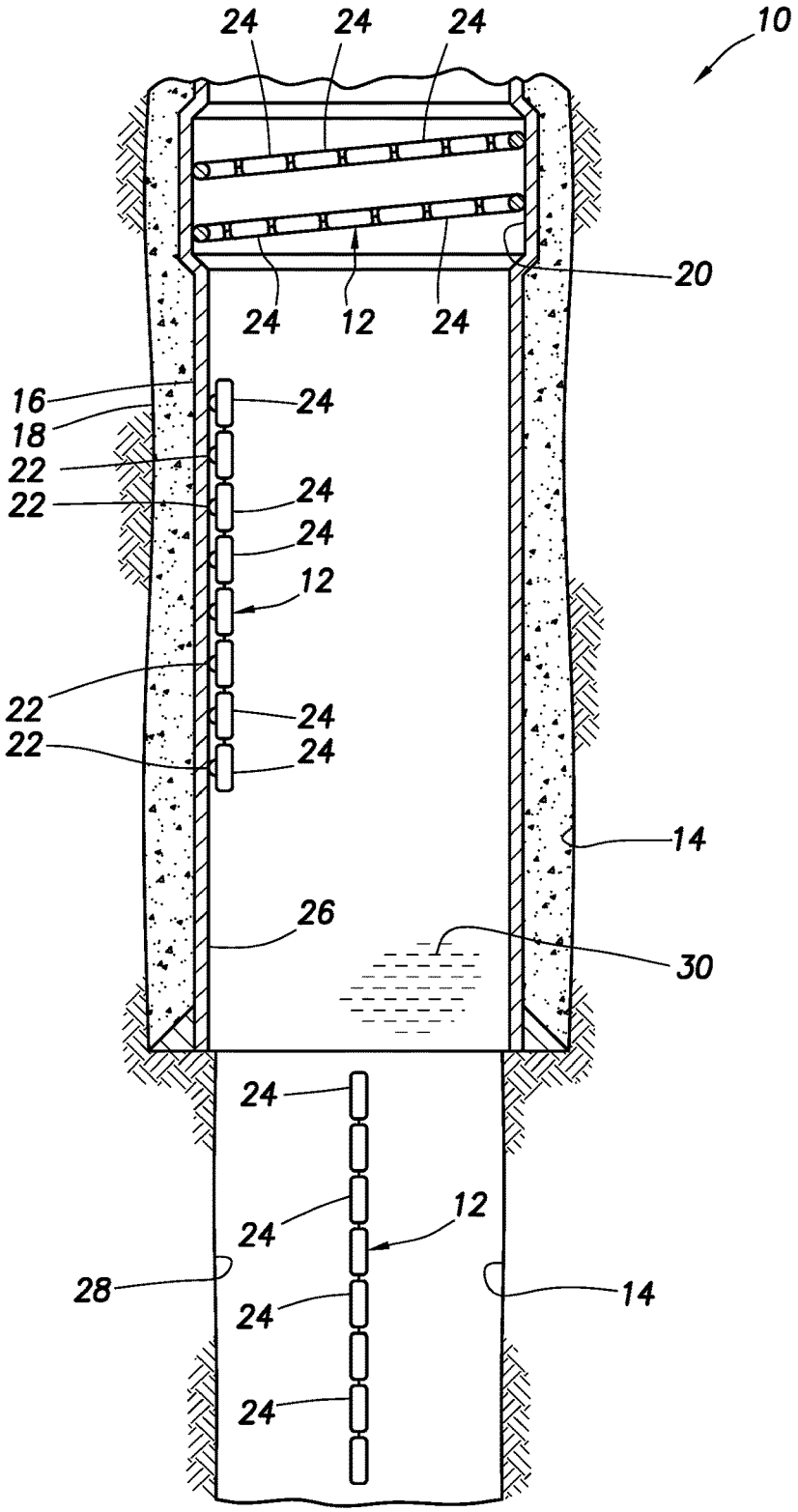
FIG. 1 is a representative partially cross-sectional view of an example of a well system and associated method which can embody principles of this disclosure.

Representatively illustrated in FIG. 1 is an example of a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, multiple telemetry apparatuses 12 are installed in a wellbore 14. It is not necessary, however, for there to be multiple telemetry apparatuses 12 in the wellbore 14, since the principles of this disclosure could be practiced with only a single apparatus in the wellbore.

The wellbore 14 as depicted in FIG. 1 has an upper section lined with casing 16 and cement 18, and a lower section that is uncased or open hole. In other examples, the entire wellbore 14 could be cased. The apparatuses 12 could be positioned in any cased and/or uncased sections of the wellbore 14, in keeping with the principles of this disclosure.

As used herein, the term "casing" indicates a generally tubular protective wellbore lining. Casing may be made up of tubulars of the type known to those skilled in the art as casing, liner or tubing. Casing may be segmented or continuous. Casing may be pre-formed or formed in situ. Thus, the scope of this disclosure is not limited to use of any particular type of casing.

As used herein, the term "cement" indicates an initially flowable substance that hardens to form a seal in a well. Cement is not necessarily cementitious, since other types of cement can include epoxies or other hardenable polymers, composites, etc. Cement may harden due to hydration of the cement, passage of time, application of heat, contact with a hardening agent, or any other stimulus. Cement may be used to secure a casing in a wellbore and seal off an annulus formed between the casing and the wellbore. Cement may be used to seal off an annulus formed between two tubular strings. Cement may be used to seal off a passage extending through a tubular string. Thus, the scope of this disclosure is not limited to use of any particular type of cement, or to any particular use for cement.

In the FIG. 1 example, the telemetry apparatuses 12 are depicted in different configurations. An upper one of the apparatuses 12 is helically arranged in a radially enlarged recess 20 formed in the casing 16. This can be considered a "parked" apparatus 12, in that the apparatus can remain motionless in the recess indefinitely.

Positioned in the recess 20, the apparatus 12 does not obstruct operations (such as, drilling, stimulation, completion, production or workover operations, etc.) that may be performed in the wellbore 14. Although the recess 20 is depicted in FIG. 1 as being formed in the casing 16, in other examples recesses may be formed by, for example, underreaming a cased or uncased section of the wellbore 14.

Figure 2:
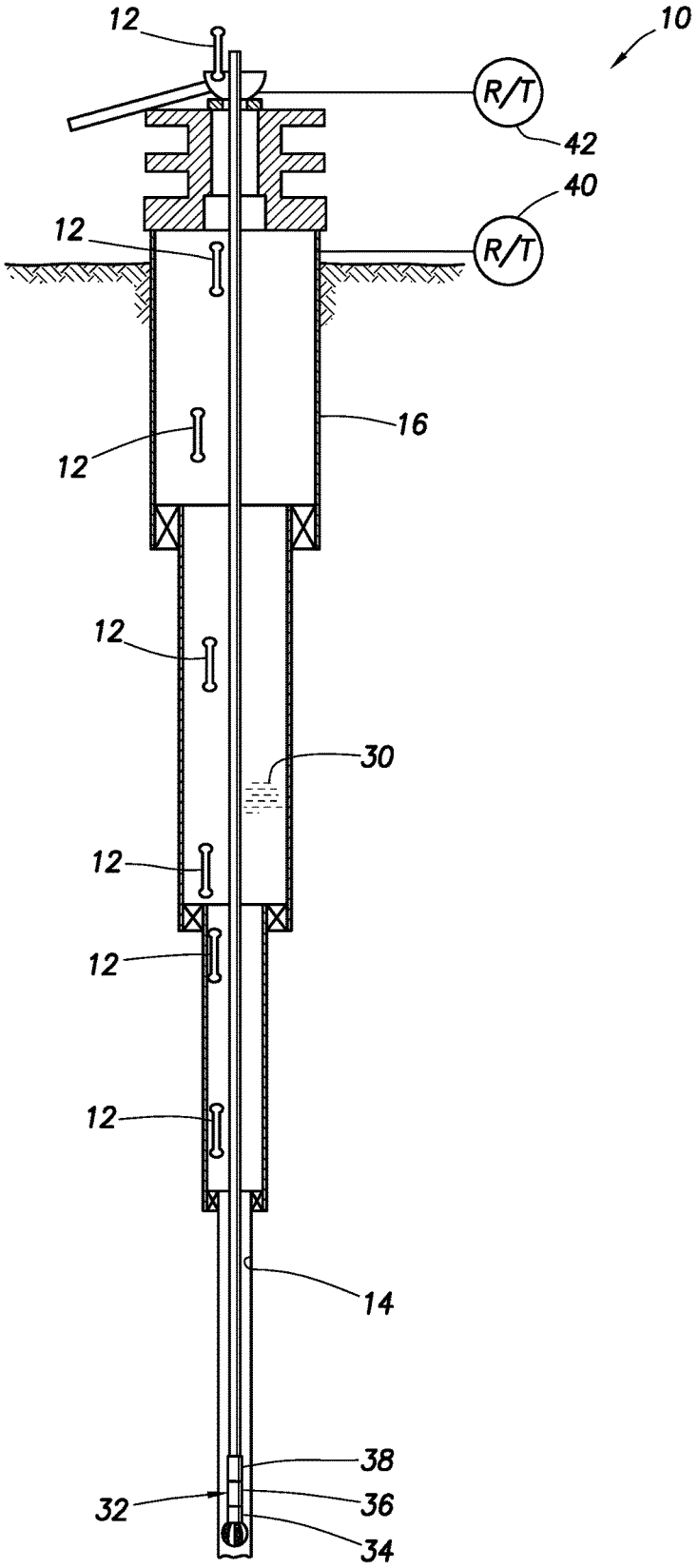
FIG. 2 is a representative partially cross-sectional view of another example of the system and method.

The recess 20 or a shoulder could be in or above a liner or tubing hanger (see, for example, FIG. 2). Thus, the scope of this disclosure is not limited to use of the recess 20 as depicted in FIG. 1.

The apparatus 12 can leave and return to the recess 20 at any time. Examples of ways the apparatus 12 can displace through the wellbore 14 are indicated by the middle and lower apparatuses 12 depicted in FIG. 1. However, it is not necessary for the apparatus 12 to be positioned in, or to displace to or away from, a recess in keeping with the scope of this disclosure.

The middle apparatus 12 depicted in FIG. 1 can displace by means of motor-driven wheels 22 extending laterally outward from segments 24 of the apparatus. The wheels 22 engage an inner surface 26 of the casing 16. If the casing 16 is made of a ferrous material, the wheels 22 could be biased into contact with the surface 26 using magnetic attraction.

If the middle apparatus 12 of FIG. 1 were instead positioned in an uncased section of the wellbore 14, the apparatus could assume a helical configuration, in order to bias the wheels 22 into contact with an inner surface 28 of the wellbore. Of course, if the wellbore 14 is inclined or horizontal, gravity can bias the wheels 22 into contact with the surfaces 26, 28.

The lower apparatus 12 depicted in FIG. 1 displaces through the wellbore 14 due to a difference in density between the apparatus and fluid 30 in the wellbore. A buoyancy of the apparatus 12 is increased to cause the apparatus to rise through the fluid in the wellbore 14, and the buoyancy of the apparatus is decreased to cause the apparatus to descend through the fluid in the wellbore.

As described more fully below, "parking" of one or more apparatuses 12 in the wellbore 14 (whether or not in the recess 20) and/or displacement of one or more apparatuses through the wellbore can provide for effective telemetry of sensor measurements, other data, commands, or other types of communication of information. In addition, the apparatuses 12 can displace or remain at any location in the wellbore 14, either autonomously, automatically and/or in response to commands transmitted from a remote location (such as, a surface control station, a subsea communication station, a bottom hole assembly, a water or land based rig, etc.).

In the FIG. 1 example, each of the apparatuses 12 comprises multiple segments 24. The segments 24 are articulable relative to one another, so that the apparatus 12 can take on various configurations (such as, the linear and helical arrangements depicted in FIG. 1). However, the scope of this disclosure is not limited to use of the articulated segments 24 in the apparatus 12.

Referring additionally now to FIG. 2, another example of the system 10 and method is representatively illustrated. In this example, multiple telemetry apparatuses 12 are installed in the wellbore 14, in order to provide for communication between a bottom hole assembly 32 and a surface location.

The bottom hole assembly 32 in the FIG. 2 example is a drilling assembly comprising a drill bit 34, one or more sensors 36 (such as, pressure, temperature, torque, weight on bit, flow, resistivity, density, fluid type and/or other types of sensors) and a telemetry device 38. In other examples, the bottom hole assembly 32 could be another type of assembly (such as, a stimulation, completion or production assembly, etc.), and the assembly could include other or different elements (such as, a drilling motor, a reamer, a stabilizer, a steering device, etc.). Thus, the scope of this disclosure is not limited to use of any particular bottom hole assembly configuration.

The telemetry device 38 of the bottom hole assembly 32 may be any type of telemetry device capable of communicating with one of the apparatuses 12. For example, pressure pulse, acoustic, electromagnetic or any other type of telemetry may be used. The telemetry device 38 may only transmit information, or may both transmit and receive information. The scope of this disclosure is not limited to use of any particular type of telemetry device 38 in the bottom hole assembly 32.

A well environment can be noisy, and interference with communications can be caused by flowing fluids and particles, presence of ferrous materials, pipes rotating or otherwise displacing in casing, etc. Thus, communicating over large distances can be difficult, impractical or impossible.

In the FIG. 2 example, by positioning one of the apparatuses 12 in relatively close proximity to the bottom hole assembly 32, the apparatus can more effectively communicate with the telemetry device 38. In addition, multiple apparatuses 12 can be distributed along the wellbore 14, so that each apparatus can effectively communicate with a telemetry device above and below that apparatus.

However, in some circumstances (such as, drilling operations), a position of the bottom hole assembly 32 can change over time, and so positions of the apparatuses 12 can also change over time. In some examples, the apparatuses 12 can be provided with "intelligence" allowing them to select appropriate spacings between them, so that effective communication is maintained as well conditions change.

For example, a first apparatus 12 introduced into the wellbore 14 may descend until it can effectively communicate with the telemetry device 38 of the bottom hole assembly 32. The apparatus 12 can then maintain a position that is at a distance no greater than that at which effective communication is maintained.

A second apparatus 12 introduced into the wellbore 14 can then descend until it can effectively communicate with the first apparatus 12. The second apparatus 12 can then maintain a position that is at a distance no greater that that at which effective communication with the first apparatus can be maintained.

This process can be repeated until a sufficient number of apparatuses 12 have been introduced into the wellbore 14, so that the last apparatus can effectively communicate with one or more telemetry devices 40, 42 at a remote location (such as, the earth's surface, a subsea location, a water or land based rig, etc.). Additional apparatuses 12 can be introduced into the wellbore 14 as needed to maintain effective communication between the telemetry device 38 of the bottom hole assembly 32 and the telemetry device(s) 40, 42 at the remote location.

Thus, the apparatuses 12 function to relay information between the telemetry device 38 and the telemetry device(s) 40, 42. In addition, the intelligence of the apparatuses 12 can be used to vary spacings between the apparatuses as needed to maintain effective communication.

For example, the spacings are not necessarily equal if more interference or noise exists in one section of the wellbore 14 as compared to other sections of the wellbore.

As another example, the spacings can change if levels of interference or noise change over time, or if the location of the bottom hole assembly 32 changes over time.

In the FIG. 2 example, the apparatuses 12 displace through the wellbore 14 in response to buoyancy changes. The apparatuses 12 do not necessarily include the articulated segments 24 depicted in the FIG. 1 example. However, the FIG. 2 apparatuses 12 could include the articulated segments 24, and could displace through the wellbore 14 by other means (such as, the motorized wheels 22 depicted in FIG. 1), in keeping with the principles of this disclosure.

The intelligence of the apparatuses 12 can be used to control their buoyancies, and to adapt to different densities of fluid 30 in the wellbore 14. Thus, the buoyancy of each apparatus 12 can be adjusted autonomously and automatically as needed to either maintain a selected position in the wellbore 14, or to rise or descend in the wellbore.

Figure 3:
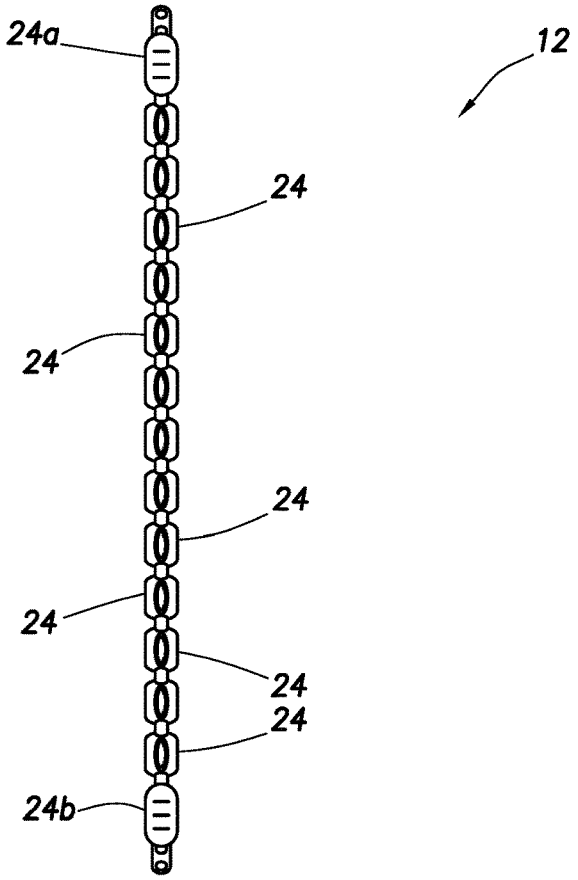
FIG. 3 is a representative side view of an example of a telemetry apparatus that may be used in the system and method, the telemetry apparatus being depicted in a linear configuration thereof.

Referring additionally now to FIG. 3, an example of the telemetry apparatus 12 is representatively illustrated, apart from the system 10 and method of FIGS. 1 & 2. The apparatus 12 of FIG. 3 may be used the system 10 and method of FIGS. 1 & 2, or it may be used in other systems and methods, in keeping with the principles of this disclosure.

In the FIG. 3 example, the apparatus 12 comprises the multiple articulated segments 24. The segments 24 are arranged in a linear configuration. In this linear configuration, the apparatus 12 can most rapidly displace along the wellbore 14 (see FIGS. 1 & 2), and can traverse obstructions, narrow passages, etc.

Note that it is not necessary for all of the segments 24 of the apparatus 12 to be identical to each other. In the FIG. 3 example, an upper segment 24*a* and a lower segment 24*b* are different from segments 24 between the upper and lower segments.

For example, the upper and lower segments 24*a,b* could include telemetry devices (not shown, see FIG. 6), whereas the middle segments 24 may not include telemetry devices. As another example, the upper segment 24*a* could include a buoyance device (not shown, see FIG. 6) for changing a buoyancy of the apparatus 12, whereas the other segments 24, 24*b* may not include buoyancy control devices. Thus, the scope of this disclosure is not limited to use of any particular configuration or combination of configurations of apparatus segments 24, 24*a,b*.

Figure 4:
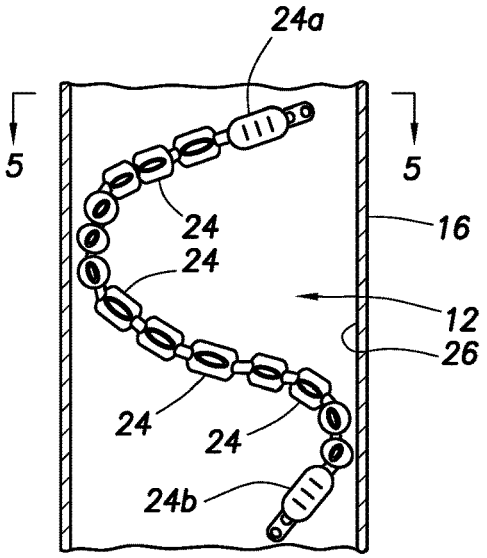
FIG. 4 is a representative partially cross-sectional view of the telemetry apparatus in a helical arrangement in a casing.
Figure 5:
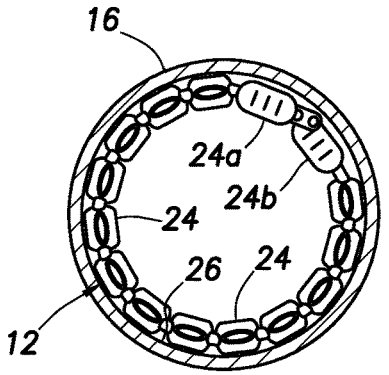
FIG. 5 is a representative cross-sectional view, taken along line 5-5 of FIG. 4.

Referring additionally now to FIGS. 4 & 5, the apparatus 12 is representatively illustrated in a helical configuration. The apparatus 12 is positioned in the casing 16, and the helical configuration enables the apparatus to effectively adapt to the casing's inner diameter and contact the inner surface 26 of the casing.

In the helical configuration, the apparatus 12 can maintain a selected position in the casing 16, for example, to enable long term "parking," to monitor well parameters at the position over time, to recharge batteries (not shown, see FIG. 6), or for other purposes. The scope of this disclosure is not limited to any particular purpose for maintaining the apparatus 12 at a certain position for an extended period of time in the helical configuration.

In the helical configuration, the apparatus 12 can also displace helically along the inner surface 26 of the casing 16 (or along the surface 28 of the wellbore 14, see FIG. 1), for example, using the motorized wheels 22 (see FIG. 1) and/or buoyancy changes. By displacing deliberately along the inner surface 26 of the casing 16, or along the surface 28 of the wellbore 14, sensors of the apparatus 12 (not shown, see FIG. 6) can sense certain well parameters along the wellbore (such as, casing integrity, cement to casing bond, flow behind casing, resistivity, density, pressure, temperature, fluid density, viscosity, etc.).

With helical displacement of the apparatus 12, it will be appreciated that a higher azimuthal resolution of sensor measurements can be obtained, and measurements can be obtained more completely about the casing 16 and wellbore 14, as compared to linear displacement of the apparatus along the wellbore. However, sensor measurements can be obtained with the apparatus 12 in the linear configuration (see FIG. 3), in keeping with the principles of this disclosure.

In one example of the method, the apparatus 12 can initially descend in a linear configuration and then, upon striking an obstruction (such as, a bridge plug or a bottom of the wellbore 14) the apparatus can change to the helical configuration. A buoyancy of the apparatus 12 can then increase, so that the apparatus (with or without assistance of the motorized wheels 22) will ascend helically along the wellbore 14 while recording/transmitting sensor measurements.

In another example, the apparatus 12 can have a built-in casing collar locating capability to ensure counting casing collars as the apparatus descends in a linear configuration. When the apparatus 12 counts a pre-programmed number of casing collars (and the apparatus is, thus, at a desired depth), the apparatus can change to the helical configuration.

In another example of the method, the apparatus 12 (or multiple apparatuses) can be initially wrapped about a tubular string (such as, a drill string or a production string) when it is deployed in the well. Then, the apparatus 12 can "unwind" from the tubular string and displace to an appropriate position in the well.

One example of using the apparatus 12 to facilitate communication between a bottom hole assembly (BHA) and surface is in logging while drilling (LWD) operations. Mud pulse telemetry can suffer from severe noise interference at surface due to high noise levels generated by surface equipment, resulting in low signal-to-noise ratio and decreased signal detection. A mud pulse telemetry receiver could be included with the apparatus 12 positioned at a location away from the surface, where the impact of surface noise is significantly reduced. Once BHA data is decoded by the apparatus 12, the data can then be recoded and telemetered to surface.

In an another example, such as in drill stem testing or well intervention operations, it can be desirable to send sensor data across packers or other well obstructions. One apparatus 12 can be positioned below the obstruction, and another apparatus 12 can be positioned above the obstruction, in order to relay data through the obstruction. Once the data is received above the obstruction, the apparatus 12 can communicate the data to the surface via conventional telemetry means, such as, acoustic telemetry, wireline, electromagnetic telemetry, etc.

Figure 6:
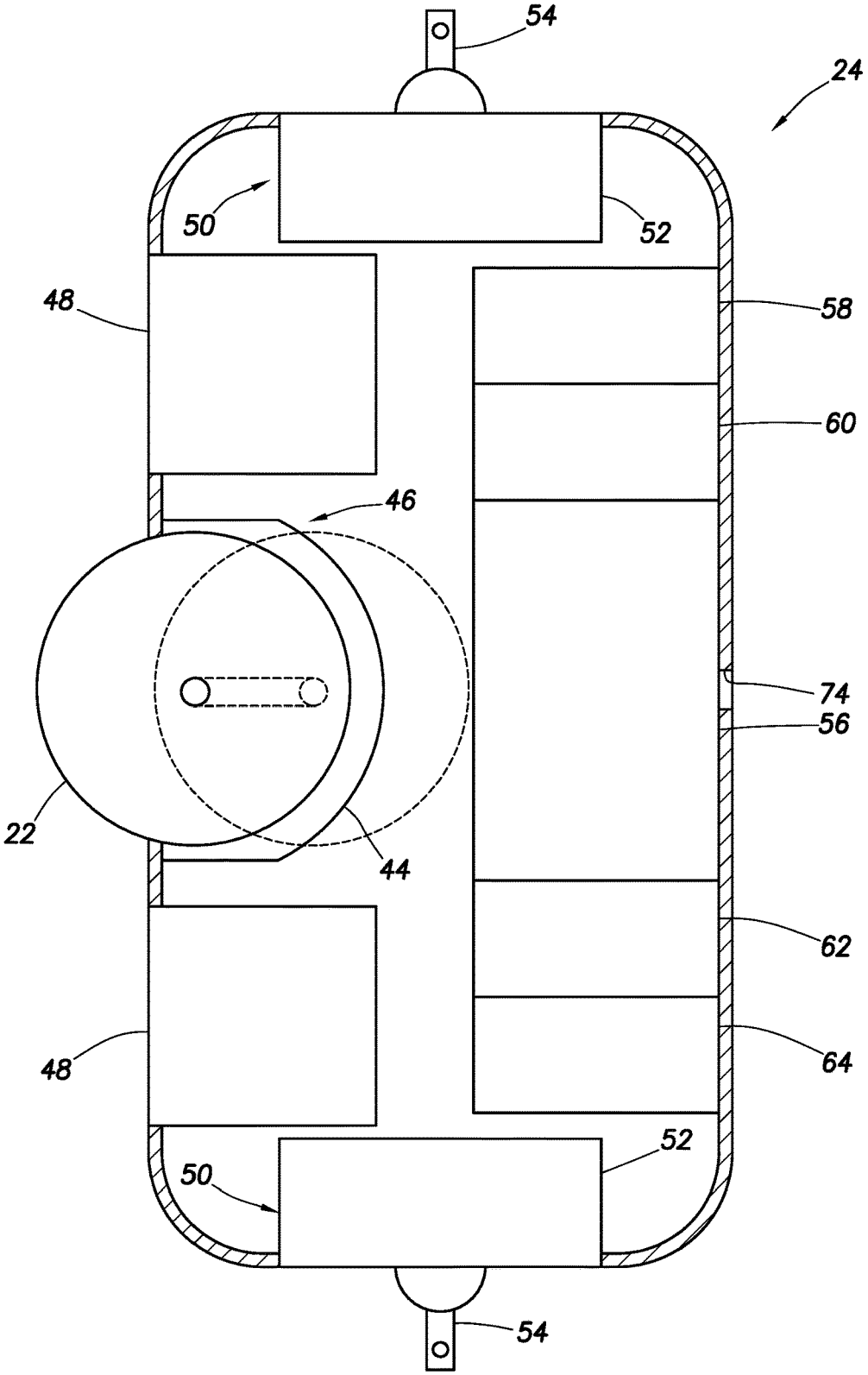
FIG. 6 is an enlarged scale representative partially cross-sectional view of a segment of the telemetry apparatus.

Referring additionally now to FIG. 6, an enlarged scale partially cross-sectional view of one example of a segment 24 of the apparatus 12 is representatively illustrated. The segment 24 depicted in FIG. 6 may be used for the upper segment 24*a*, the lower segment 24*b* or any other segment 24 of the apparatus 12. However, it should be clearly understood that the segment 24 depicted in FIG. 6 is merely one example of a particular segment configuration, and a wide variety of other examples may be used, in keeping with the principles of this disclosure.

In the FIG. 6 example, the segment 24 includes the wheel 22, which is rotated by a motor 44. The motor 44 may also include an actuator (not shown) for inwardly retracting the wheel 22. For example, if the apparatus 12 is displacing through the wellbore 14 (see FIGS. 1 & 2) in the linear configuration due to a buoyancy change, or if the apparatus is parked or otherwise maintaining its position in the wellbore, then the wheel 22 may not be needed and can be retracted.

The wheel 22 and motor 44 can be considered an engagement device 46 for engaging a well surface (such as, the inner surface 26 of the casing 16, the surface 28 of the wellbore 14, etc.). In some examples, the wheel 22 could be magnetized or made of a magnetic material, so that the wheel is biased into contact with the casing surface 26 or another well surface due to magnetic attraction.

Alternatively, or in addition, one or more magnetic engagement devices 48 (such as, permanent magnets and/or electromagnets, etc.) may be included in the segment 24 to bias the segment toward a well surface due to magnetic attraction. If the wheel 22 is extended, the magnetic attraction can be used to bias the wheel into contact with the well surface. If the wheel 22 is retracted, the magnetic attraction can be used to secure the apparatus 12 in position (that is, to prevent displacement of the apparatus along the wellbore 14).

The FIG. 6 segment 24 example also includes an articulation device 50 at each opposite end of the segment. The articulation devices 50 are used to control relative orientation between the segment 24 and adjacent segments connected at the opposite ends of the segment. Of course, if the segment 24 is at either opposite end of the apparatus 12, then there is only one adjacent segment, and so only one articulation device 50 may be used.

The articulation device 50 in the FIG. 6 segment 24 example includes an actuator 52 and a connecting arm 54. The actuator 52 is used to displace the arm 54 and thereby control the orientation of the segment 24 relative to an adjacent segment connected to the arm.

The actuator 52 can displace the arm 54 in three dimensions, in two dimensions, in one dimension, rotationally, longitudinally, laterally or in any other manner, in keeping with the principles of this disclosure. In some examples, the actuator 52 may comprise piezoelectric, magnetostrictive, electrostrictive, or other types of electromagnetically active materials, although conventional servos, solenoids or other types of motion-producing mechanisms may be used, if desired.

Figure 7:
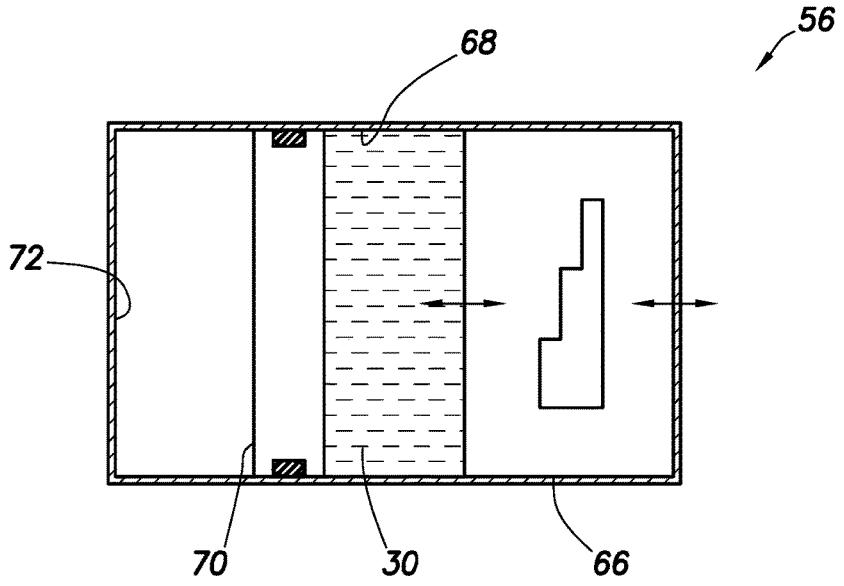
FIGS. 7 & 8 are representative schematic views of a buoyancy control device that may be used in the telemetry apparatus.
Figure 8:
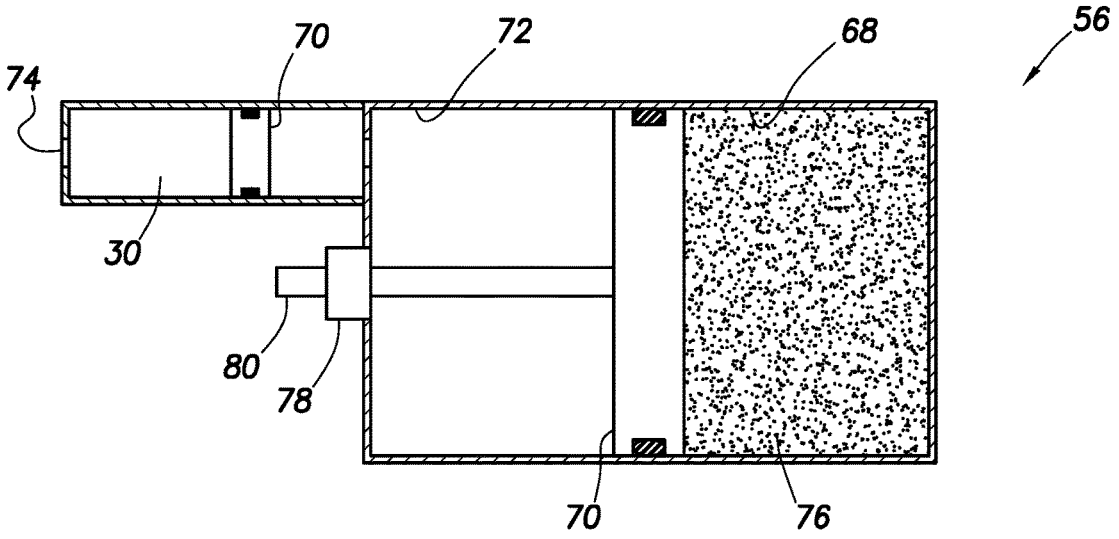

The FIG. 6 segment 24 example also includes a buoyancy control device 56, a power source 58, a computing device 60, one or more sensors 62 and a telemetry device 64. The buoyancy control device 56 is used to maintain or change a buoyancy of the segment 24 and thereby maintain or change a buoyancy of the overall apparatus 12 as needed to maintain or change a position of the apparatus in the wellbore 14 (see FIGS. 1 & 2). Examples of the buoyancy control device 56 are depicted in FIGS. 7 & 8, and are described more fully below.

The buoyancy control can be coordinated with well operations. For example, in a drilling operation, the apparatus 12 may be parked during actual drilling. When drilling fluid flow is stopped (such as, during a drill pipe connection make-up), the apparatus 12 can descend to a position closer to the bottom hole assembly 32 (see FIG. 2) if needed, or multiple apparatuses can adjust their spacing for optimal data transmission. The apparatuses 12 would again park upon resumption of drilling fluid flow.

The power source 58 is used to provide electrical power to the various other electrical devices of the segment 24. The power source 58 may include batteries and/or an electrical generator. If an electrical generator is included, the generator may generate electrical power in response to fluid flow, heat, or other stimulus in the wellbore 14.

The computing device 60 is used to control operation of the other devices of the segment 24, to store and process sensor measurements, and to otherwise embody the "intelligence" of the segment. In the FIG. 6 example, the computing device 60 controls operation of the engagement devices 46, 48, the articulation devices 50, the buoyancy control device 56 and the telemetry device 64, stores and processes measurements made by the sensors 62, and stores and executes instructions (e.g., in the form of software, firmware, etc.) for the various functions performed by the computing device. The computing device 60 can include at least one processor and at least one memory (e.g., volatile, non-volatile, erasable, programmable, etc., memory) for executing and storing instructions, data, etc.

The sensors 62 are used to measure well parameters of interest. The sensors 62 can include pressure, temperature, resistivity, density, fluid type and composition, fluid density, viscosity, acoustic, electromagnetic, optical or any other type of sensors. Pressure measurements may be used to inform and/or modify buoyancy control. Accelerometers, gyroscopes, etc. may be used to determine position and navigate in the well. The scope of this disclosure is not limited to use of any particular type or combination of sensors.

The telemetry device 64 is used to transmit and receive signals comprising sensor measurements, other data, handshake protocols, commands, other information, etc. The signals may comprise pressure pulse, acoustic, electromagnetic, optical or any other type or combination of telemetry signal. The telemetry device 64 may be capable of switching from one type of telemetry signal reception or transmission to another type of telemetry signal reception or transmission. The scope of this disclosure is not limited to use of any particular type of telemetry device.

Referring additionally now to FIG. 7, an example of the buoyancy control device 56 is representatively and schematically illustrated, apart from the remainder of the segment 24 of FIG. 6. However, the buoyancy control device 56 of FIG. 7 may be used with other segments, in keeping with the principles of this disclosure.

In the FIG. 7 example, the buoyancy control device 56 includes a positive displacement pump 66 that transfers well fluid 30 between an exterior of the segment 24 and a chamber 68 (for example, via a port 74 in the segment, see FIG. 6). A floating piston 70 sealingly separates the chamber 68 from a gas-filled chamber 72.

As the pump 66 fills the chamber 68 with the fluid 30, the chamber 72 decreases in volume, and the buoyancy of the segment 24 decreases. Conversely, as the pump 66 discharges fluid 30 from the chamber 68 to the exterior of the segment 24, the chamber 72 increases in volume, and the buoyancy of the segment 24 increases.

It will be appreciated that the FIG. 7 depiction of the buoyancy control device 56 is simplified and a wide variety of variations are possible. For example, the piston 70 could be replaced with a membrane, bladder or other type of displaceable fluid barrier. Instead of using the pump 66, the piston 70 could be displaced by a motor (not shown) to control the relative volumes of the chambers 68, 72. Thus, the scope of this disclosure is not limited at all to any of the details of the buoyancy control device 56 depicted in FIG. 7.

Referring additionally now to FIG. 8, another example of the buoyancy control device 56 is representatively illustrated. In this example, the volume of the chamber 72 is controlled by controlling a volume of a substance 76 in the chamber 68. The volume of the substance 76 may change in response to any stimulus (such as, heat, electrical or magnetic input, etc.). A latching device 78 engaged with a rod 80 attached to the piston 70 may be used to maintain a desired position of the piston.

It may now be fully appreciated that the above disclosure provides significant advancements to the art of communicating in a well. The telemetry apparatus 12 in certain examples described above is capable of relaying information between downhole and surface telemetry devices 38, 40, 42, or between itself and surface telemetry device(s) 40, 42, does not require any tether (such as, a wireline, slickline, control line, optical line, etc.), and can operate autonomously to achieve effective communication in a well.

A telemetry apparatus 12 for use in a well is provided to the art by the above disclosure. In one example, the telemetry apparatus 12 can comprise multiple segments 24, the segments including at least one buoyancy control device 56, at least one telemetry device 64, and at least one articulation device 50 that controls a relative orientation between adjacent ones of the segments 24. The segments 24 are not necessarily identical to each other.

The segments 24 can include at least one engagement device 46, 48 that engages a well surface 26, 28. The engagement device 48 may comprise a magnetic device. The engagement device 46 may comprise a motorized wheel 22.

The segments 24 can include a sensor 62 that measures a well parameter. The segments 24 may be helically arranged, linearly arranged, or otherwise arranged.

The "at least one" articulation device 50 may comprise multiple articulation devices. Each of the segments 24 can comprise one or more of the articulation devices 50.

Also provided to the art by the above disclosure is a method of communicating in a subterranean well. In one example, the method comprises: installing at least one telemetry apparatus 12 in the well, the telemetry apparatus comprising a first telemetry device 64 and a buoyancy control device 56; and the first telemetry device 64 communicating with a second telemetry device 38, 40, 42 at a remote location (such as, a remote location in the well, a surface location, a subsea location, a water or land based rig, etc.).

The method can include the telemetry apparatus 12 displacing in the well in response to the buoyancy control device 56 changing a buoyancy of the telemetry apparatus 12.

The "at least one" telemetry apparatus 12 can comprise multiple telemetry apparatuses, and method can include the telemetry apparatuses 12 distributing themselves in the well, with spacings between the telemetry apparatuses being at most maximum spacings having effective communication between the telemetry devices 64 of successive ones of the telemetry apparatuses 12.

The second telemetry device 38 may be disposed in a bottom hole assembly 32, and the method can include the second telemetry device 38 receiving measurements from a sensor 36 of the bottom hole assembly 32 and transmitting the sensor measurements to the first telemetry device 64.

The second telemetry device 40, 42 may be disposed at a surface location, and the method can include the second telemetry device 40, 42 receiving sensor measurements from the first telemetry device 64.

The telemetry apparatus 12 may comprise multiple segments 24, and the method can include changing relative orientations between adjacent ones of the segments 24 in the well. The changing step can comprise helically arranging the segments 24.

A well system 10 is also described above. In one example, the system 10 can comprise: at least one telemetry apparatus 12 disposed in a wellbore 14, the telemetry apparatus comprising multiple segments 24, the segments including at least one buoyancy control device 56 and at least one telemetry device 64.

The segments 24 may include at least one articulation device 50 that controls a relative orientation between adjacent ones of the segments. The segments 24 may include at least one engagement device 46, 48 that engages a surface 26, 28 in the wellbore 14.

The "at least one" telemetry apparatus 12 may comprise multiple telemetry apparatuses. The telemetry apparatuses 12 may be distributed in the wellbore 14, with spacings between the telemetry apparatuses being at most maximum spacings having effective communication between the telemetry devices 64 of successive ones of the telemetry apparatuses.

The telemetry apparatus 12 may displace in the wellbore 14 in response to a change in buoyancy of the telemetry apparatus.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A telemetry apparatus for use in a well, the telemetry apparatus comprising:

multiple segments, wherein the multiple segments are directly coupled to each other, the multiple segments comprising:

at least one buoyancy control device, at least one telemetry device, at least one engagement device that engages a well surface, wherein the engagement device biases the telemetry apparatus toward an inner surface of the well, and at least one articulation device that controls a relative orientation between adjacent ones of the segments, wherein the at least one articulation device comprises an actuator and a connecting arm, wherein the telemetry apparatus is arranged in a helical shape against the inner surface of the well by changing the relative orientation between the multiple segments.

2. The telemetry apparatus of claim 1, wherein the engagement device comprises a magnetic device.

3. The telemetry apparatus of claim 1, wherein the engagement device comprises a motorized wheel.

4. The telemetry apparatus of claim 1, wherein the segments further comprise a sensor that measures a well parameter.

5. The telemetry apparatus of claim 1, wherein the at least one articulation device comprises multiple articulation devices, and wherein each of the segments comprises at least one of the multiple articulation devices.

6. A method of communicating in a subterranean well, the method comprising:

disposing a first telemetry apparatus in the well, the first telemetry apparatus comprising a first telemetry device and a buoyancy control device, wherein the first telemetry apparatus comprises multiple segments, wherein the multiple segments are directly coupled to each other wherein the first telemetry apparatus comprises an engagement device that engages a well surface, wherein the engagement device biases the first telemetry apparatus toward an inner surface of the well;

displacing the first telemetry apparatus in the well in response to the buoyancy control device changing a buoyancy of the first telemetry apparatus;

changing the relative orientations between the multiple segments, wherein the multiple segments form a helical shape against the inner surface of the well, wherein the helical shape causes the first telemetry apparatus to remain motionless;

disposing a second telemetry apparatus in the well, the second telemetry apparatus comprising a second telemetry device and the buoyancy control device, wherein the second telemetry apparatus comprises multiple segments, wherein the multiple segments are directly coupled to each other, wherein the second telemetry apparatus comprises an engagement device that engages a well surface, wherein the engagement device biases the second telemetry apparatus toward the inner surface of the well;

displacing the second telemetry apparatus in the well in response to the buoyancy control device changing a buoyancy of the second telemetry apparatus;

changing the relative orientations between the multiple segments, wherein the multiple segments form a helical shape against the inner surface of the well, wherein the helical shape causes the second telemetry apparatus to remain motionless; and transmitting a signal from the first telemetry device to the second telemetry device.

7. A well system, comprising:

at least one telemetry apparatus disposed in a wellbore, the telemetry apparatus comprising multiple segments, wherein the multiple segments are directly coupled to each other, wherein the multiple segments can change orientations relative to each other, wherein the multiple segments comprise:

at least one buoyancy control device;

at least one engagement device that engages a wellbore surface, wherein the engagement device biases the at least one telemetry apparatus toward an inner surface of the wellbore; and at least one telemetry device, wherein the at least one telemetry apparatus is arranged in a helical shape against the inner surface of the wellbore by changing the relative orientation between the multiple segments.

8. The well system of claim 7, wherein the segments further include at least one articulation device that controls a relative orientation between adjacent ones of the segments.

9. The well system of claim 7, wherein the well system comprises multiple telemetry apparatuses, and wherein the telemetry apparatuses are distributed in the wellbore, with spacings between the telemetry apparatuses being at most maximum spacings having effective communication between the telemetry devices of successive ones of the telemetry apparatuses.

10. The well system of claim 7, wherein the telemetry apparatus displaces in the wellbore in response to a change in a buoyancy of the telemetry apparatus.

* * * * *